US009972265B2

(12) United States Patent
Na et al.

(10) Patent No.: US 9,972,265 B2
(45) Date of Patent: May 15, 2018

(54) DISPLAY APPARATUS, METHOD OF DRIVING DISPLAY PANEL USING THE SAME AND DRIVER FOR THE DISPLAY APPARATUS

(71) Applicant: SAMSUNG DISPLAY CO., LTD., Yongin, Gyeonggi-Do (KR)

(72) Inventors: Hoe-Seok Na, Gwangmyeong-si (KR); Yong-Doo Park, Jeonju-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 93 days.

(21) Appl. No.: 14/674,674

(22) Filed: Mar. 31, 2015

(65) Prior Publication Data

US 2016/0111055 A1 Apr. 21, 2016

(30) Foreign Application Priority Data

Oct. 16, 2014 (KR) ..... 10-2014-0140042

(51) Int. Cl.
*G09G 3/36* (2006.01)

(52) U.S. Cl.
CPC ... *G09G 3/3666* (2013.01); *G09G 2310/0297* (2013.01); *G09G 2310/04* (2013.01); *G09G 2310/08* (2013.01); *G09G 2320/10* (2013.01); *G09G 2330/023* (2013.01)

(58) Field of Classification Search
CPC ..... G09G 3/3666; G09G 2320/10; G09G 2310/04; G09G 2310/0297; G09G 2330/023; G09G 2310/08
See application file for complete search history.

(56) References Cited

U.S. PATENT DOCUMENTS 5,511,201 A * 4/1996 Kamimaki ..... G09G 3/3406 713/310
2004/0008170 A1* 1/2004 Makino ..... G09G 3/3651 345/87
2009/0273555 A1* 11/2009 Song ..... G09G 3/3666 345/96
2012/0147020 A1* 6/2012 Hussain ..... G06T 1/00 345/522
2012/0194773 A1* 8/2012 Kim ..... G02F 1/13336 349/139

(Continued)

FOREIGN PATENT DOCUMENTS

KR 1020050019172 3/2005
KR 1020110133715 12/2011

(Continued)

*Primary Examiner* — Aneeta Yodichkas
(74) *Attorney, Agent, or Firm* — F. Chau & Associates, LLC

(57) ABSTRACT

A display apparatus includes a display panel and a timing controller. The display panel includes a first display area on which a first gate line group is disposed and a second display area on which a second gate line group is disposed. The second gate line group is disconnected from the first gate line group. The timing controller is configured to determine a first driving frequency of the first display area based on first image data displayed on the first display area and a second driving frequency of the second display area based on second image data displayed on the second display area.

19 Claims, 9 Drawing Sheets

(56) References Cited

U.S. PATENT DOCUMENTS

| | | | | |
|---|---|---|---|---|
| 2013/0257925 | A1* | 10/2013 | Kim | H04N 13/0434 345/691 |
| 2014/0085276 | A1* | 3/2014 | Jang | G09G 3/2007 345/204 |

FOREIGN PATENT DOCUMENTS

| | | |
|---|---|---|
| KR | 1020140076252 | 6/2014 |
| KR | 1020150100978 | 9/2015 |

* cited by examiner

DISPLAY APPARATUS, METHOD OF DRIVING DISPLAY PANEL USING THE SAME AND DRIVER FOR THE DISPLAY APPARATUS

CROSS-REFERENCE TO RELATED APPLICATIONS

This application claims priority under 35 U.S.C. § 119 to Korean Patent Application No. 10-2014-0140042, filed on Oct. 16, 2014 in the Korean Intellectual Property Office KIPO, the disclosure of which is incorporated by reference in its entirety herein.

BACKGROUND

1. Technical Field

Exemplary embodiments of the inventive concept relate to a display apparatus and a method of driving a display panel using the display apparatus.

2. Discussion of Related Art

Methods for minimizing power consumption of an information technology (IT) product such as a tablet personal computer (PC) and a laptop PC have been studied.

To minimize power consumption of an IT product which includes a display panel, a power consumption of the display apparatus may be minimized. When the display panel displays a static image, the display panel may be driven with a relatively low frequency so that a power consumption of the display apparatus may be reduced.

However, in this method, the power consumption is not reduced when the display panel displays moving images. Thus, power consumption may not be sufficiently decreased.

SUMMARY

At least one exemplary embodiment of the inventive concept provides a display apparatus capable of reducing a power consumption.

At least one exemplary embodiment of the present inventive concept provides a method of driving a display apparatus using the display apparatus.

According to an exemplary embodiment of the inventive concept, a display apparatus display apparatus includes a display panel and a timing controller. The display panel includes a first display area on which a first gate line group is disposed and a second display area on which a second gate line group is disposed. The second gate line group is disconnected from the first gate line group. The timing controller is configured to determine a first driving frequency of the first display area based on first image data displayed on the first display area and a second driving frequency of the second display area based on second image data displayed on the second display area.

In an exemplary embodiment, the first display area and the second display area may be adjacent to each other in a horizontal direction.

In an exemplary embodiment, a size of the first display area may be substantially the same as a size of the second display area.

In an exemplary embodiment, the display apparatus may further include a first gate driver configured to apply a gate signal to the first gate line group and a second gate driver configured to apply a gate signal to the second gate line group.

In an exemplary embodiment, when the first input image data includes a video image, the timing controller may determine the first driving frequency as a high driving frequency. When the first input image data only includes a static image, the timing controller may determine the first driving frequency as a low driving frequency. When the second input image data includes a video image, the timing controller may determine the second driving frequency as a high driving frequency. When the second input image data only includes a static image, the timing controller may determine the second driving frequency as a low driving frequency.

In an exemplary embodiment, when the second input data includes both a video image and a static image, the second gate driver may output gate signals only to gate lines corresponding to the video image.

In an exemplary embodiment, when the second input data includes both a video image and a static image, the timing controller may generate a gate masking signal which blocks gate clock pulses outputted to gate lines corresponding to the static image.

In an exemplary embodiment, when the second input data includes both a video image and a static image, the second gate driver may output gate signals to gate lines from a vertical start point of the video image.

In an exemplary embodiment, the second gate driver may include a gate demux. The gate demux may be configured to receive an input vertical start signal and N selecting signals and to select an output vertical start signal from $2^N$ output vertical start signals, the selected output vertical start signal representing the vertical start point of the video image.

In an exemplary embodiment, the display apparatus may further include a data driver configured to output data voltages to the first display area and the second display area. When the first input image data only includes a static image, a buffer part corresponding to the first input image data of the data driver may be turned off during a blank period. For example, when the first input image data only includes a static image, a buffer part of the data driver that performs a buffering based on the first input image data may be turned off during the blank period.

In an exemplary embodiment, the display apparatus may further include a data driver configured to output data voltages to the first display area and the second display area. When the first input image data only includes a static image, a power voltage may not be provided to a portion corresponding to the first input image data of the data driver during a blank period. For example, when the first input image data only includes a static image, a power voltage may not be provided during a blank period to a portion of the data driver that processes the first input image data.

In an exemplary embodiment of the inventive concept, a method of driving a display panel includes determining a first driving frequency based on first input image data, where the first input image data are displayed on a first display area on which a first gate line group is located, determining a second driving frequency based on second input image data, where the second input image data are displayed on a second display area on which a second gate line group is located and driving the first display area in the first driving frequency and the second display area in the second driving frequency.

In an exemplary embodiment, when the first input image data includes a video image, the first driving frequency may be determined as a high driving frequency. When the first input image data only includes a static image, the first driving frequency may be determined as a low driving frequency. When the second input image data includes a video image, the second driving frequency may be determined as a high driving frequency. When the second input image data only includes a static image, the second driving frequency may be determined as a low driving frequency.

In an exemplary embodiment, when the second input data includes both a video image and a static image, gate signals may be outputted only to gate lines corresponding to the video image.

In an exemplary embodiment, when the second input data includes both a video image and a static image, a gate masking signal which blocks gate clock pulses outputted to gate lines corresponding to the static image may be generated.

In an exemplary embodiment, when the second input data includes both a video image and a static image, gate signals may be outputted to gate lines from a vertical start point of the video image.

In an exemplary embodiment, when the second input data includes both a video image and a static image, an output vertical start signal may be selected from $2^N$ output vertical start signals based on an input vertical start signal and N selecting signals, and the gate signals may be outputted to the gate lines from a gate line directed by the selected output vertical start signal.

In an exemplary embodiment, the method may further include outputting a data voltage to the first display area and the second display area. When the first input image data only includes a static image, a buffer part corresponding to the first input image data of a data driver may be turned off during a blank period.

In an exemplary embodiment, the method may further include outputting a data voltage to the first display area and the second display area. When the first input image data only includes a static image, a power voltage may not be provided to a portion corresponding to the first input image data of a data driver during a blank period.

According to an embodiment of a display apparatus and an embodiment of a method of driving a display panel of the display apparatus, the driving frequency is adjusted according to an image displayed on the display panel so that a power consumption of the display apparatus may be reduced. In addition, when a first portion of the display panel displays a video image and a second portion of the display panel displays a static image, the first portion is driven with a relatively high driving frequency and the second portion is driven with a relatively low driving frequency so that a power consumption of the display apparatus may be further reduced.

According to an exemplary embodiment of the inventive concept, a driver for a display apparatus includes a gate driver and a timing controller. The timing controller is configured instruct the gate driver to apply a gate clock signal of a high frequency to a first set of gate lines of the display apparatus that correspond to a first portion of input image data representing a static image during a frame period, block pulses of the gate clock signal using a masking signal to generate a gate clock signal of a low frequency, and instruct the gate driver to apply the gate clock signal of the low frequency to a second set of gate lines of the display apparatus that correspond to a second portion of the input image data representing a moving image during the frame period. In an exemplary embodiment, the gate driver includes a first gate driver and a second gate driver, where among the first and second gate drivers the first set of gate lines is only connected to the first gate driver, and among the first and second gate drivers the second set of gate lines is only connected to the second gate driver. In an exemplary embodiment, the gate driver includes a first gate driver and a second gate driver, where the first and second set of gate lines are both connected to the first gate driver, and among the first and second gate drivers a third set of gate lines of the display apparatus is only connected to the second gate driver.

BRIEF DESCRIPTION OF THE DRAWINGS

The inventive concept will become more apparent by describing detailed exemplary embodiments thereof with reference to the accompanying drawings, in which.

DETAILED DESCRIPTION

Hereinafter, exemplary embodiments the inventive concept will be explained in detail with reference to the accompanying drawings.

Figure 1:
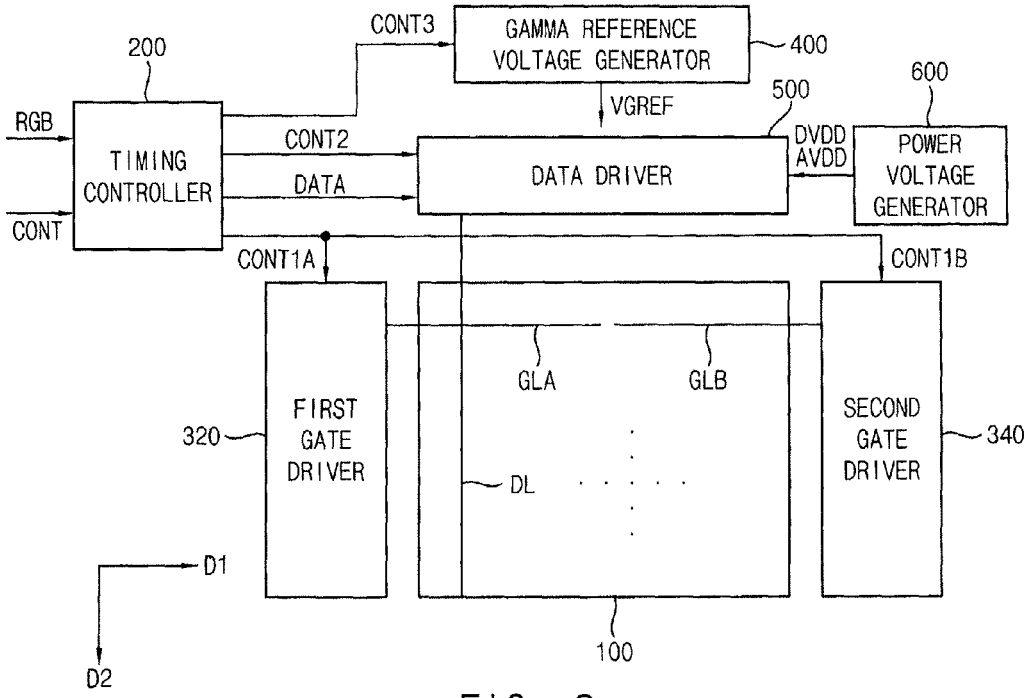
FIG. 1 is a block diagram illustrating a display apparatus according to an exemplary embodiment of the inventive concept.
Figure 2:
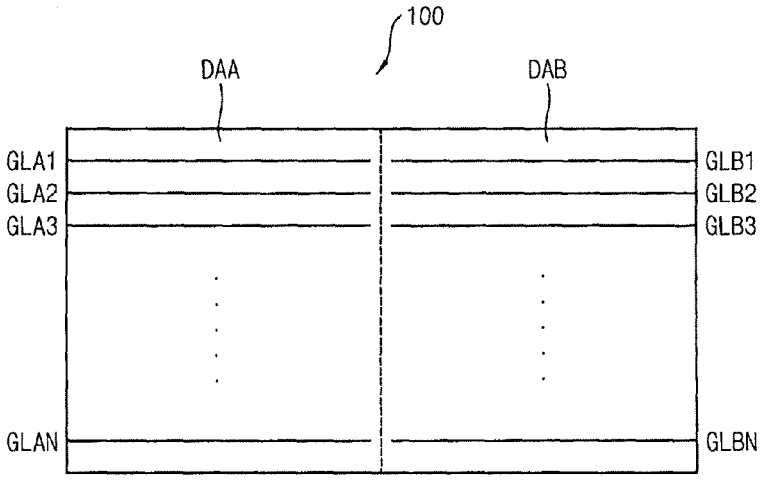
FIG. 2 is a plan view illustrating a display panel of FIG. 1.

FIG. 1 is a block diagram illustrating a display apparatus according to an exemplary embodiment of the present inventive concept. FIG. 2 is a plan view illustrating a display panel 100 of FIG. 1.

Referring to FIGS. 1 and 2, the display apparatus includes a display panel 100 and a panel driver. The panel driver includes a timing controller 200, a first gate driver 320, a second gate driver 340, a gamma reference voltage generator 400, a data driver 500 and a power voltage generator 600.

The display panel 100 has a display region on which an image is displayed and a peripheral region adjacent to the display region. The peripheral region may surround the display panel 100.

The display panel 100 includes a plurality of gate lines GLA and GLB, a plurality of data lines DL and a plurality of pixels connected to the gate lines GLA and GLB and the data lines DL. The gate lines GLA and GLB extend in a first direction D1 and the data lines DL extend in a second direction D2 crossing the first direction D1.

The display panel 100 includes a first display area DAA on which a first gate line group GLA is disposed and a second display area DAB on which a second gate line group GLB is disposed.

For example, the first display area DAA and the second display area DAB may be adjacent to each other in a horizontal direction.

For example, a size of the first display area DAA may be substantially the same as a size of the second display area DAB.

Each pixel includes a switching element (not shown), a liquid crystal capacitor (not shown) and a storage capacitor (not shown). The liquid crystal capacitor and the storage capacitor are electrically connected to the switching element. The pixels may be disposed in a matrix format.

The timing controller 200 receives input image data RGB and an input control signal CONT from an external apparatus (not shown). The input image data may include red image data R, green image data G and blue image data B. The input control signal CONT may include a master clock signal and a data enable signal. The input control signal CONT may further include a vertical synchronizing signal and a horizontal synchronizing signal.

The timing controller 200 generates a first control signal CONT1A and CONT1B, a second control signal CONT2, a third control signal CONT3 and a data signal DATA based on the input image data RGB and the input control signal CONT.

The timing controller 200 generates a first gate control signal CONT1A for controlling an operation of the first gate driver 320 based on the input control signal CONT, and outputs the first gate control signal CONT1A to the first gate driver 320. The first gate control signal CONT1A may further include a vertical start signal and a gate clock signal.

The timing controller 200 generates a second gate control signal CONT1B for controlling an operation of the second gate driver 340 based on the input control signal CONT, and outputs the second gate control signal CONT1B to the second gate driver 340. The second gate control signal CONT1B may further include a vertical start signal and a gate clock signal.

The timing controller 200 generates the second control signal CONT2 for controlling an operation of the data driver 500 based on the input control signal CONT, and outputs the second control signal CONT2 to the data driver 500. The second control signal CONT2 may include a horizontal start signal and a load signal.

The timing controller 200 generates the data signal DATA based on the input image data RGB. The timing controller 200 outputs the data signal DATA to the data driver 500.

The timing controller 200 determines a driving frequency of the display panel 100 based on the input image data RGB. The timing controller 200 determines a first driving frequency of the first display area DAA based on first input image data displayed on the first display area DAA. The timing controller 200 determines a second driving frequency of the second display area DAB based on second input image data displayed on the second display area DAB.

When the first input image data includes a video image or a moving image, the timing controller 200 determines the first driving frequency as a high driving frequency. When the first input image data only represents a static image, the timing controller 200 determines the first driving frequency as a low driving frequency.

When the second input image data includes a video image or a moving image, the timing controller 200 determines the second driving frequency as a high driving frequency. When the second input image data only represent a static image, the timing controller 200 determines the second driving frequency as a low driving frequency.

Therefore, in an exemplary embodiment, the first driving frequency of the first display area DAA may be different from the second driving frequency of the second display area DAB. When the first input image data includes a video image or a moving image and the second input image data includes a video image or a moving image, the first display area DAA and the second display area DAB are driven with the same high driving frequency. When the first input image data only represents a static image and the second input image data only represents a static image, the first display area DAA and the second display area DAB are driven with the same low driving frequency.

For example, the high driving frequency may be one of 60 hertz (Hz), 120 Hz and 240 Hz. In an exemplary embodiment, the high driving frequency does not vary according to the input image data RGB.

For example, the low driving frequency is less than the high driving frequency. For example, the low driving frequency may be one of 30 Hz, 20 Hz, 10 Hz and 1 Hz. In an exemplary embodiment, the low driving frequency varies according to the input image data RGB.

The timing controller 200 may generate a power control signal of the display panel 100 based on the input image data RGB. The power control signal controls a power control operation of the data driver 500.

In an exemplary embodiment, the power control signal instructs a turn off timing of one or more elements in the data driver 500. In an exemplary embodiment, when the power control signal has a first logic state (e.g., a high level), a buffer part of the data driver 500 is turned off so that the data driver 500 is operated in a power saving mode. In an exemplary embodiment, when the power control signal has a second logic state (e.g., a low level) different from the first logic state, the buffer part of the data driver 500 is turned on so that the data driver 500 is operated in a normal mode.

In an exemplary embodiment, the power control signal has the first logic state (e.g., the high level) during a vertical blank period of the data signal DATA and a low frequency blank period due to the low frequency driving. A sum of the vertical blank period and the low frequency blank period may be referred to as a blank period in the present exemplary embodiment.

The vertical blank period is defined between frames of the data signal DATA regardless of the input image data RGB.

When the input image data RGB only represents a static image, the display area is driven with the low driving frequency. When the display area is driven with the low driving frequency, the display panel is referred to be operating in a low frequency mode. In the low frequency mode, the data signal DATA is not outputted during the low frequency blank period. For example, when the high driving frequency is 60 Hz and the low driving frequency is 20 Hz, in the low frequency mode, the data signal DATA is normally outputted during ⅓ of a frame (normal output period) and the data signal DATA is not outputted during ⅔ of the frame (low frequency blank period).

During a blank period of the first input image data for the first display area DAA, the timing controller 200 does not output the first gate control signal CONT1A to the first gate driver 320. For example, during the blank period of the first input image data, the timing controller 200 does not output the vertical start signal to the first gate driver 320.

During a blank period of the second input image data for the second display area DAB, the timing controller 200 does not output the second gate control signal CONT1B to the second gate driver 340. For example, during the blank period of the second input image data, the timing controller 200 does not output the vertical start signal to the second gate driver 340.

In addition, during the blank period of the first input image data, the timing controller 200 does not output the second control signal CONT2 and the data signal DATA to an area of the data driver 500 corresponding to the first input image data. For example, during the blank period of the first input image data, the timing controller 200 does not output the horizontal start signal, the load signal and the data signal DATA to the area of the data driver 500 corresponding to the first input image data.

In addition, during the blank period of the second input image data, the timing controller 200 does not output the second control signal CONT2 and the data signal DATA to an area of the data driver 500 corresponding to the second input image data. For example, during the blank period of the second input image data, the timing controller 200 does not output the horizontal start signal, the load signal and the data signal DATA to the area of the data driver 500 corresponding to the second input image data.

The timing controller 200 generates the third control signal CONT3 for controlling an operation of the gamma reference voltage generator 400 based on the input control signal CONT, and outputs the third control signal CONT3 to the gamma reference voltage generator 400.

The first gate driver 320 generates gate signals driving the gate lines in the first gate line group GLA in response to the first gate control signal CONT1A received from the timing controller 200. The first gate driver 320 sequentially outputs the gate signals to the gate lines in the first gate line group GLA.

The second gate driver 340 generates gate signals driving the gate lines in the second gate line group GLB in response to the second gate control signal CONT1B received from the timing controller 200. The second gate driver 340 sequentially outputs the gate signals to the gate lines in the second gate line group GLB.

The first and second gate drivers 320 and 340 may be directly mounted on the display panel 100, or may be connected to the display panel 100 as a tape carrier package (TCP) type. Alternatively, the first and second gate drivers 320 and 340 may be integrated on the display panel 100.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an exemplary embodiment, the gamma reference voltage generator 400 is disposed in the data driver 500. Alternatively, the gamma reference voltage generator 400 may be disposed in the timing controller 200.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The data driver 500 may be directly mounted on the display panel 100, or be connected to the display panel 100 in a TCP type. Alternatively, the data driver 500 may be integrated on the display panel 100.

A structure and an operation of the data driver 500 is explained in detail below with reference to FIG. 9.

The power voltage generator 600 generates power voltages DVDD and AVDD and outputs the power voltages DVDD and AVDD to the data driver 500. During the blank period of the first input image data, the power voltage generator 600 does not output the power voltages to the portion of the data driver 500 corresponding to the first input image data. During the blank period of the second input image data, the power voltage generator 600 does not output the power voltages to the portion of the data driver 500 corresponding to the second input image data. For example, the data driver 500 may include a first part for processing the first input image data and a second part distinct from the first part for processing the second input image data. For example, during the blank period of the first input image data, the power voltage generator 600 would not output power to the first part. For example, during the blank period of the second input image data, the power voltage generator 600 would not output power to the second part.

Figure 3:
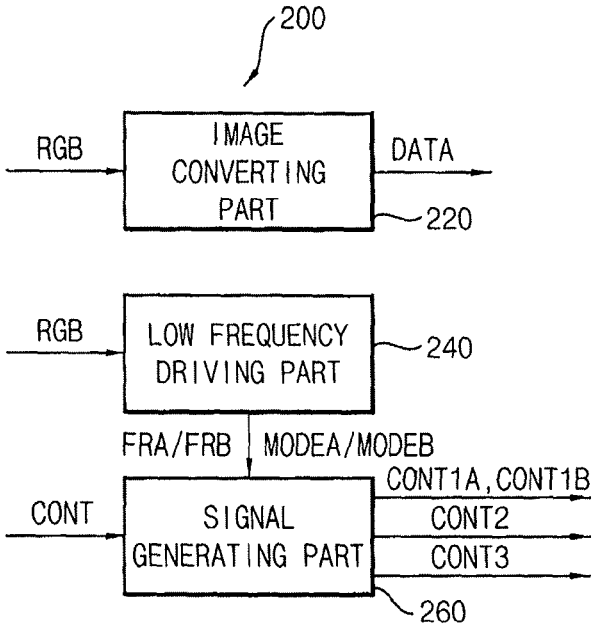
FIG. 3 is a block diagram illustrating a timing controller of FIG. 1 according to an exemplary embodiment of the inventive concept.

FIG. 3 is a block diagram illustrating the timing controller 200 of FIG. 1 according to an exemplary embodiment of the inventive concept.

Referring to FIGS. 1 to 3, the timing controller 200 includes an image converting part 220, a low frequency driving part 240 and a signal generating part 260.

The image converting part 220 compensates grayscale data of the input image data RGB and rearranges the input image data RGB to generate the data signal DATA to correspond to a data type of the data driver 500. The data signal DATA may have a digital type. The image converting part 220 outputs the data signal DATA to the data driver 500.

For example, the image converting part 220 may include an adaptive color correcting part (not shown) and a dynamic capacitance compensating part (not shown).

The adaptive color correcting part receives the grayscale data of the input image data RGB, and performs an adaptive color correction ("ACC") on the grayscale data. The adaptive color correcting part may compensate the grayscale data using a gamma curve.

The dynamic capacitance compensating part performs a dynamic capacitance compensation ("DCC"), which compensates the grayscale data of present frame data using previous frame data and the present frame data.

The low frequency driving part 240 receives the input image data RGB. The low frequency driving part 240 determines the driving frequency FRA and FRB of the display panel 100 based on the input image data RGB. The low frequency driving part 240 may determine a first driving frequency FRA of the first display area DAA of the display panel 100 based on the first input image data. The low frequency driving part 240 may determine a second driving frequency FRB of the second display area DAB of the display panel 100 based on the second input image data.

In addition, the low frequency driving part 240 generates the power control signal MODEA and MODEB based on the input image data RGB. The low frequency driving part 240 generates a first power control signal MODEA of the first display area DAA based on the first input image data. The low frequency driving part 240 generates a second power control signal MODEB of the second display area DAB based on the second input image data.

The low frequency driving part 240 outputs the driving frequency FRA and FRB and the power control signal MODEA and MODEB to the signal processing part 260.

The signal generating part 260 receives the input control signal CONT. The signal generating part 260 generates the first gate control signal CONT1A to control a driving timing of the first gate driver 320 based on the input control signal CONT, the first driving frequency FRA and the first power control signal MODEA. The signal generating part 260 generates the second gate control signal CONT1B to control a driving timing of the second gate driver 340 based on the input control signal CONT, the second driving frequency FRB and the second power control signal MODEB.

The signal generating part 260 generates the second control signal CONT2 to control a driving timing of the data driver 500 based on the input control signal CONT, the driving frequency FRA and FRB and the power control signal MODEA and MODEB.

The signal generating part 260 generates the third control signal CONT3 to control a driving timing of the gamma reference voltage generator 400 based on the input control signal CONT, the driving frequency FRA and FRB and the power control signal MODEA and MODEB.

The signal generating part 260 outputs the first gate control signal CONT1A to the first gate driver 320. The signal generating part 260 outputs the second gate control signal CONT1B to the second gate driver 340. The signal generating part 260 outputs the second control signal CONT2 to the data driver 500. The signal generating part 260 outputs the third control signal CONT3 to the gamma reference voltage generator 400. In an exemplary embodiment, the second control signal CONT2 includes the power control signal MODEA and MODEB.

Figure 4:
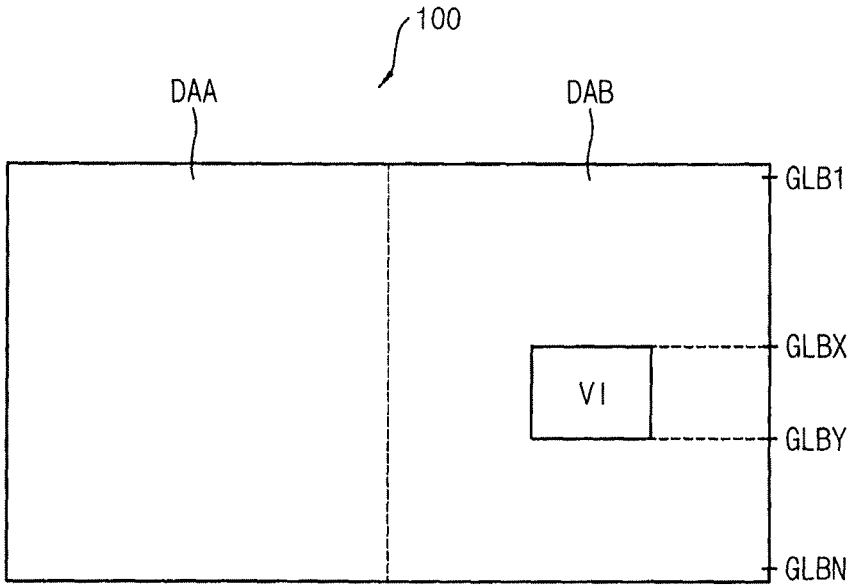
FIG. 4 is a conceptual diagram illustrating the display panel of FIG. 1 when a portion of a second display area of the display panel displays a video image.
Figure 5:
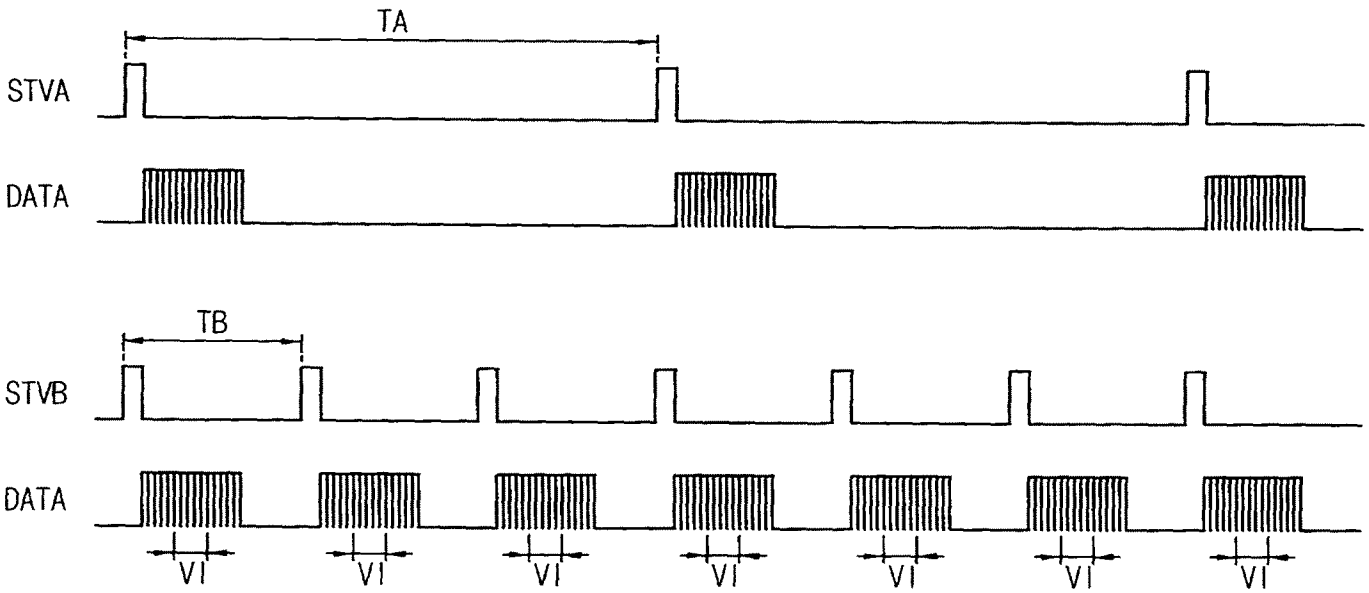
FIG. 5 is a timing diagram illustrating driving signals of the display panel of FIG. 1 when the portion of the second display area of the display panel displays a video image.
Figure 6:
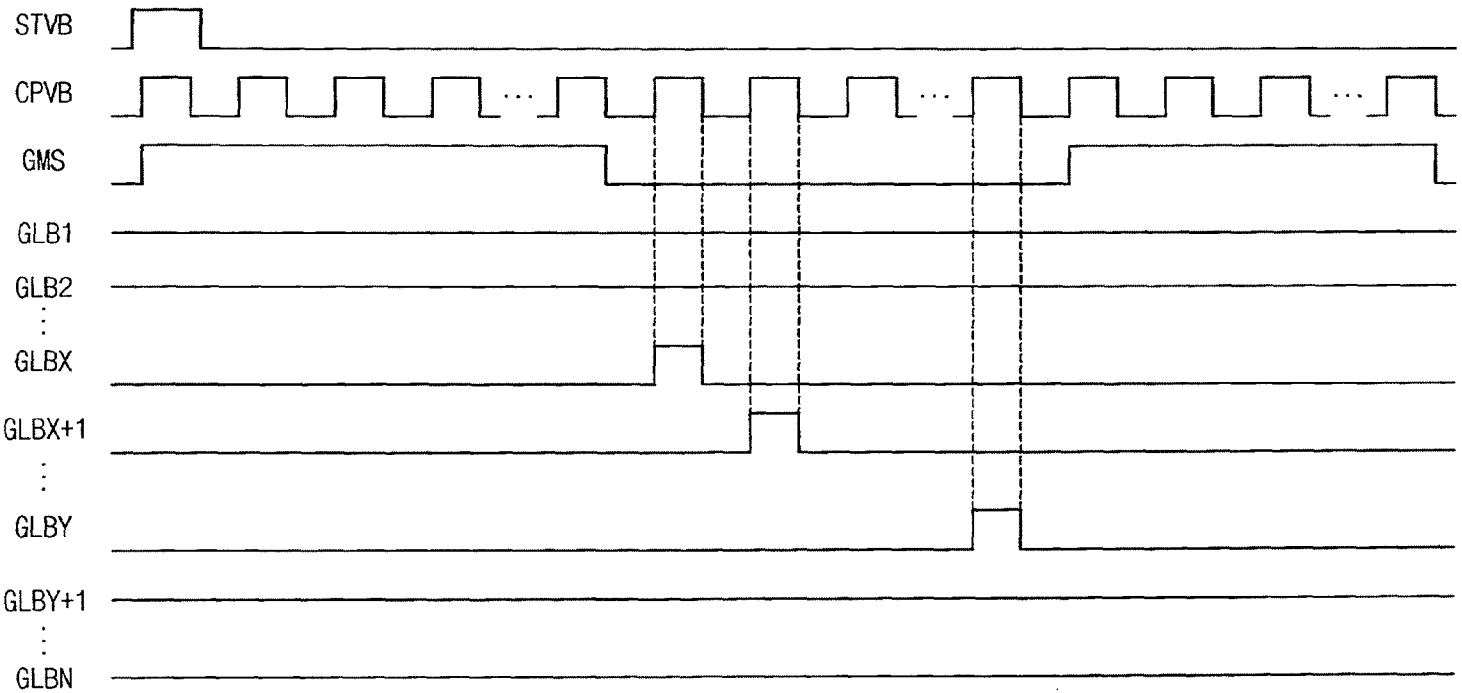
FIG. 6 is a timing diagram illustrating input and output signals of a second gate driver of FIG. 1 when the portion of the second display area of the display panel displays a video image.

FIG. 4 is a conceptual diagram illustrating the display panel 100 of FIG. 1 when a portion of a second display area of the display panel 100 displays a video image VI or a moving image. FIG. 5 is a timing diagram illustrating driving signals of the display panel 100 of FIG. 1 when the portion of the second display area of the display panel 100 displays a video image VI or a moving image. FIG. 6 is a timing diagram illustrating input and output signals of a second gate driver 340 of FIG. 1 when the portion of the second display area of the display panel 100 displays a video image VI or a moving image.

Referring to FIGS. 1 to 6, the first display area DAA does not display a video image and only displays a static image in FIG. 4. A portion of the second display area DAB displays a video image VI and remaining portions of the second display area DAB display a static image in FIG. 4.

Since the first input image data of the first display area DAA only includes a static image, the first display area DAA is driven with a low driving frequency. Since the second input image data of the second display area DAB includes a video image, the second display area DAB is driven with a high driving frequency.

In FIG. 5, a driving frequency of the second display area DAB is higher than a frequency of the first display area DAA by three times. Thus, a frame cycle TB of the second display area DAB which is defined by time between adjacent pulses of a vertical start signal STVB is ⅓ of a frame cycle TA of the first display area DAA which is defined by time between adjacent pulses of a vertical start signal STVA. While, the higher frequency is described as being three times the lower frequency, the invention concept is not limited this ratio, as the higher frequency may be less than three times the lower frequency or greater than three times the lower frequency in alternate embodiments.

In an exemplary embodiment of the inventive concept, when only the second display area DAB among the first and second display areas DAA and DAB includes a video image, the first display area DAA is driven with a low driving frequency. The above explained method is called to a horizontal local low frequency driving method. By using the horizontal local low frequency driving method, the power consumption of the display apparatus may be reduced.

The video image VI is not displayed in the whole second display area DAB but a portion of the second display area DAB. The video image VI is displayed between an X-th gate line GLBX and a Y-th gate line GLBY in the second gate line group GLB.

In first and fourth frames which commonly correspond to the frame cycle TA of the low frequency driving and the frame cycle TB of the high frequency driving in FIG. 5, the second gate driver 340 outputs gate signals to all gate lines in the second display area DAB.

In second, third, fifth and sixth frames which correspond to the frame cycle TB of the high frequency driving in FIG. 5, the second gate driver 340 outputs gate signals to the gate lines GLBX to GLBY corresponding to the video image VI.

In the second, third, fifth and sixth frames, the timing controller 200 generates a gate masking signal GMS, which blocks gate clock pulses outputted to the gate lines corresponding to a static image, to output gate pulses to the gate lines GLBX to GLBY corresponding to the video image VI.

The gate signals applied to the second gate driver 340 are generated using a second gate clock CPVB and the gate masking signal GMS. The gate masking signal GMS masks gate signals applied to a first gate line GLB1 to an (X−1)-th gate line GLBX−1 corresponding to a static image. The gate masking signal GMS also masks gate signals applied to a (Y+1)-th gate line GLBY+1 to last gate line GLBN corresponding to a static image.

While the disclosure discusses masking out $2^{nd}$, $3^{rd}$, $5^{th}$, and $6^{th}$ pulses, the inventive concept is not limited thereto. A high frequency clock signal including multiple pulses can be converted into a lower frequency clock signal by masking out pulses at a ratio different from every two out of three pulses (e.g., ⅓, ¾). For example, in a ¾ masking, a clock signal including four pulses is converted into a lower frequency clock signal by retaining the $1^{st}$ pulse and masking out the $2^{nd}$, $3^{rd}$, and $4^{th}$ pulses. For example, an OR operation can be performed on a masking signal having a logic low level and the clock signal when the $1^{st}$ pulse occurs to retain the $1^{st}$ pulse and then an XOR operation can be performed on the masking signal having a high level and the clock signal when the $2^{nd}$, $3^{rd}$, and $4^{th}$ pulses occur to mask out the $2^{nd}$, $3^{rd}$, and $4^{th}$ pulses.

When the gate signal is masked, the data driver 500 corresponding to the second display area DAB does not output the data voltage. For example, while a gate signal is sequentially applied to the gate lines in a first region displaying a static image, the masking is performed, and then after entering a second region displaying a moving image, the masking is no longer performed until entering a subsequent region displaying the static image.

In an exemplary embodiment, in the frames which only correspond to the frame cycle TB of the high frequency driving, the gate signals of the portion displaying the video image VI in the second display area DAB is normally outputted and the gate signals of the portion displaying the static image in the second display area DAB is blocked so that the portion displaying the video image VI is driven in a high driving frequency and the portion displaying the static image is driven in a low driving frequency. The above explained driving method is referred to as a vertical local low frequency driving method. By using the vertical local low frequency driving method, the power consumption of the display apparatus may be further reduced.

Figure 7:
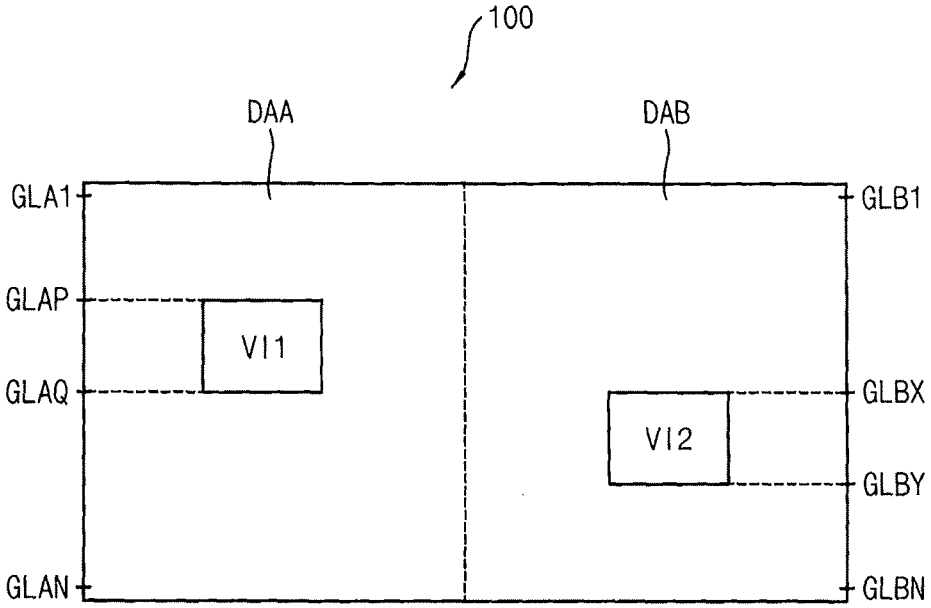
FIG. 7 is a conceptual diagram illustrating the display panel of FIG. 1 when a portion of a first display area and a portion of a second display area of the display panel respectively display video images.
Figure 8:
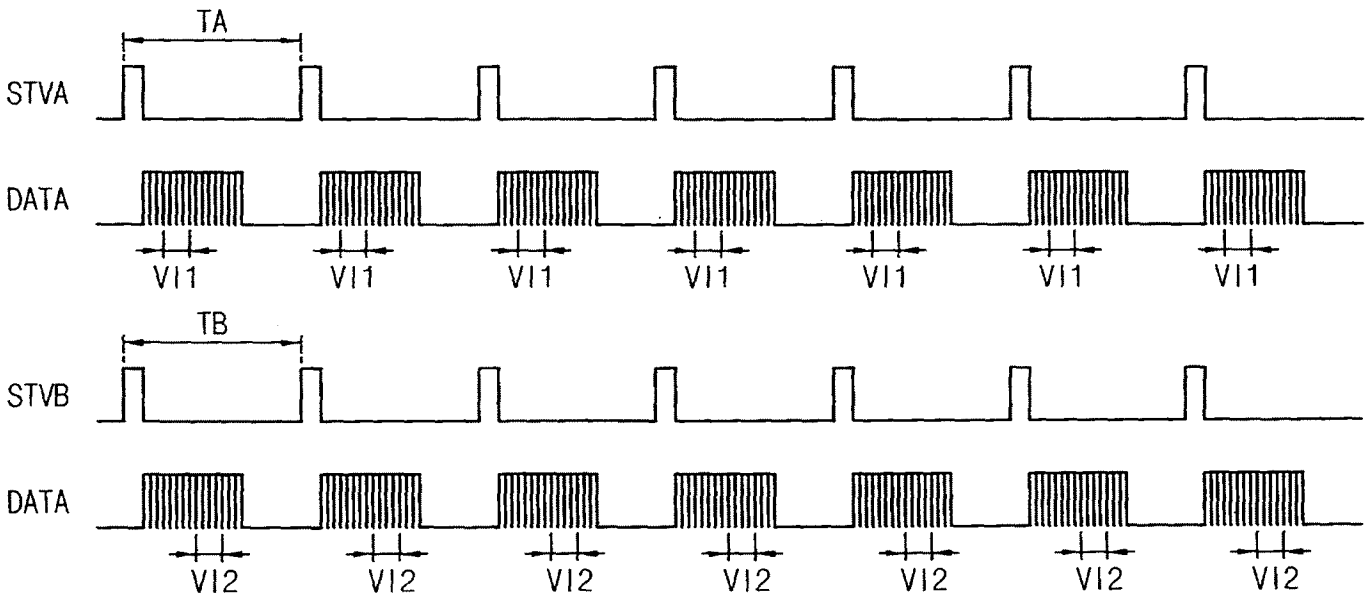
FIG. 8 is a timing diagram illustrating driving signals of the display panel of FIG. 1 when the portion of the first display area and the portion of the second display area of the display panel respectively display video images.

FIG. 7 is a conceptual diagram illustrating the display panel 100 of FIG. 1 when a portion of the first display area DAA and a portion of the second display area DAB of the display panel 100 respectively display video images. FIG. 8 is a timing diagram illustrating driving signals of the display panel 100 of FIG. 1 when the portion of the first display area DAA and the portion of the second display area DAB of the display panel 100 respectively display video images.

Referring to FIGS. 1 to 3, 7 and 8, a portion of the first display area DAA displays a first video image VI1 and remaining portions of the first display area DAA display a static image in FIG. 7. A portion of the second display area DAB displays a second video image VI2 and remaining portions of the second display area DAB display a static image in FIG. 7.

Since the first input image data of the first display area DAA includes a video image, the first display area DAA is driven with a high driving frequency. Since the second input image data of the second display area DAB includes a video image, the second display area DAB is driven with a high driving frequency.

In FIG. 8, a high driving frequency corresponding to a video image is higher than a low driving frequency corresponding to a static image by three times like FIG. 5.

The first video image VI1 is not displayed in the whole first display area DAA but a portion of the first display area DAA. The first video image VI1 is displayed between a P-th gate line GLAP and a Q-th gate line GLAQ in the first gate line group GLA.

In first and fourth frames which commonly correspond to the frame cycle TA (in FIG. 5) of the low frequency driving and the frame cycle TA (in FIG. 8) of the high frequency driving, the first gate driver 340 outputs gate signals to all the gate lines in the second display area DAA. For example, in the first and fourth frames, regardless of whether a static or moving image is being applied to respective portions of the display, no masking is performed.

In second, third, fifth and sixth frames which correspond to the frame cycle TA (in FIG. 8) of the high frequency driving, the second gate driver 340 outputs gate signals to the gate lines GLAP to GLAQ corresponding to the first video image VI1. For example, in the second, third, fifth, and six frames, while a video image VI1 is being applied to a portion of the display, the masking is not performed.

In the second, third, fifth and sixth frames, the timing controller 200 generates a gate masking signal, which blocks gate clock pulses outputted to the gate lines corresponding to a static image, to output gate pulses to the gate lines GLAP to GLAQ corresponding to the first video image VI1. For example, in the second, third, fifth, and sixth frames, while a static image is being applied to another portion of the display, the masking is performed.

In an exemplary embodiment, in the frames which only correspond to the frame cycle TA (in FIG. 8) of the high frequency driving, the gate signals of the portion displaying the first video image VI1 in the first display area DAA is normally outputted and the gate signals of the portion displaying the static image in the first display area DAA is blocked so that the portion displaying the first video image VI1 is driven with a high driving frequency and the portion displaying the static image is driven with a low driving frequency. By using the vertical local low frequency driving method, the power consumption of the display apparatus may be further reduced.

The second video image VI2 is not displayed in the whole second display area DAB but a portion of the second display area DAB. The second video image VI2 is displayed between an X-th gate line GLBX and a Y-th gate line GLBY in the second gate line group GLB.

In first and fourth frames which commonly correspond to the frame cycle TA (in FIG. 5) of the low frequency driving and the frame cycle TB (in FIG. 8) of the high frequency driving, the second gate driver 340 outputs gate signals to all the gate lines in the second display area DAB. For example, in the first and fourth frames, no masking of the gate signals occurs.

In second, third, fifth and sixth frames which correspond to the frame cycle TB (in FIG. 8) of the high frequency driving in FIG. 5, the second gate driver 340 outputs gate signals to the gate lines GLBX to GLBY corresponding to the second video image VI2. For example, in the second, third, fifth, and sixth frames, while the video image VI2 is being applied in the area corresponding gate lines GLBX to GLBY, no masking of the gate signals occurs.

In the second, third, fifth and sixth frames, the timing controller 200 generates a gate masking signal, which blocks gate pulses outputted to the gate lines corresponding to a static image, to output gate pulses to the gate lines GLBX to GLBY corresponding to the second video image VI2. For example, in the second, third, fifth, and sixth frames, while the static image is being applied in the areas outside gate lines GLBX to GLBY, the masking occurs.

In an exemplary embodiment, in the frames which only correspond to the frame cycle TB (in FIG. 8) of the high frequency driving, the gate signals of the portion displaying the video image VI2 in the second display area DAB is normally outputted and the gate signals of the portion displaying the static image in the second display area DAB is blocked so that the portion displaying the second video image VI2 is driven in a high driving frequency and the portion displaying the static image is driven in a low driving frequency. By using the vertical local low frequency driving method, the power consumption of the display apparatus may be further reduced.

Figure 9:
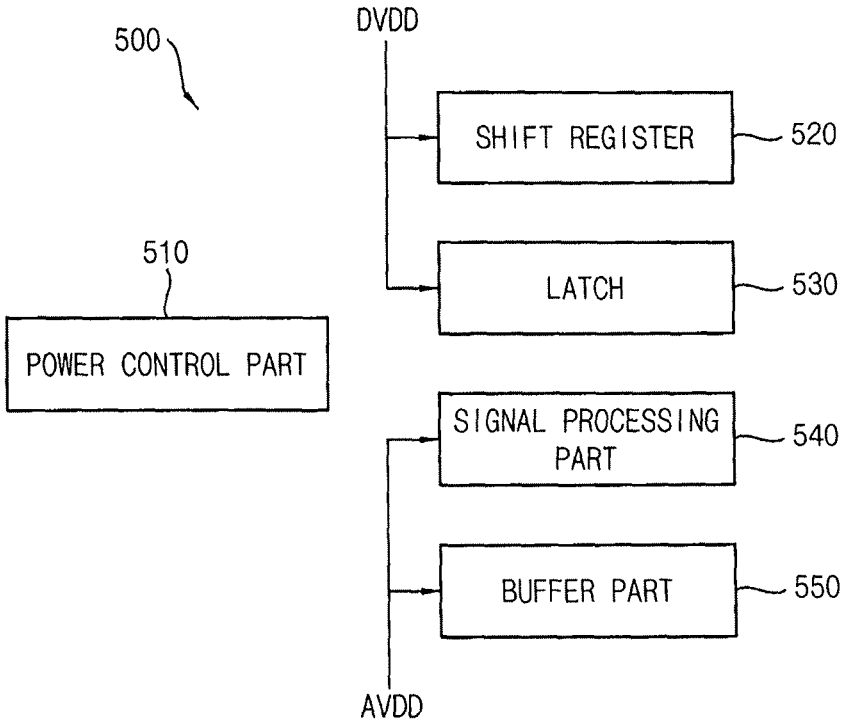
FIG. 9 is a block diagram illustrating a data driver of FIG. 1 according to an exemplary embodiment of the inventive concept.

FIG. 9 is a block diagram illustrating the data driver 500 of FIG. 1 according to an exemplary embodiment of the inventive concept.

Referring to FIGS. 1 to 9, the data driver 500 includes a power control part 510, a shift register 520, a latch 530, a signal processing part 540 and a buffer part 550.

The data driver 500 receives the power voltages DVDD and AVDD from the power voltage generator 600. A power voltage DVDD having a first level may be applied to the shift register 520 and the latch 530. A power voltage AVDD having a second level may be applied to the signal processing part 540 and the buffer part 550. For example, the second level may be greater than the first level.

The power control part 510 receives the power control signal MODEA and MODEB. The power control part 510 turns on or off elements of the data driver 500 according to the power control signal MODEA and MODEB to reduce the power consumption.

When the first input image data only includes a static image, the power control part 510 turns off the buffer part 550 corresponding to the first input image data of the data driver 500 during the blank period. In an exemplary embodiment, turning off the buffer part 550 corresponding to the first input image data, turns off the buffer part 550 or suppresses power to the buffer part 550 while the buffer part 550 is being used to buffer the first input image data. In an exemplary embodiment, the buffer part 550 includes a first buffer for buffering the first input image data and a second buffer for buffering the second input image data. In an exemplary embodiment, turning off the buffer part 550 corresponding to the first input image data turns off the first buffer or suppresses power to the first buffer.

When the second input image data only includes a static image, the power control part 510 turn offs the buffer part 550 corresponding to the second input image data of the data driver 500 during the blank period. In an exemplary embodiment, turning off the buffer part 550 corresponding to the second input image data, turns off the buffer part 550 or suppresses power to the buffer part 550 while the buffer part 550 is being used to buffer the second input image data. In an exemplary embodiment, turning off the buffer part 550 corresponding to the second input image data, turns off the second buffer or suppresses power to the second buffer.

When the first input image data only includes a static image, the power voltages DVDD and AVDD are not provided to the portion of the data driver 500 corresponding to the first input image data. In an exemplary embodiment, not providing power voltages to the portion of the data driver 500 corresponding to the first input image data, suppresses power to the data driver 500 when the data driver 500 is processing the first input image data. In an exemplary embodiment, the data driver 500 includes a first section for processing the first input image data and a second distinct section for processing the second input image data, and not providing power voltages to the portion of the data driver 500 corresponding to the first input image data suppresses power to the first section.

When the second input image data only includes a static image, the power voltages DVDD and AVDD are not provided to the portion of the data driver 500 corresponding to the second input image data. In an exemplary embodiment, not providing power voltages to the portion of the data driver 500 corresponding to the second input image data, suppresses power to the data driver 500 when the data driver 500 is processing the second input image data. In an exemplary embodiment, not providing power voltages to the portion of the data driver 500 corresponding to the second input image data suppresses power to the second section.

In an exemplary embodiment, the shift register 520 is a group of process registers having a linear type in a digital circuit. The shift register 520 outputs a latch pulse to the latch 530. In an exemplary embodiment, the shift register 520 is a cascade of flip flops, sharing a same clock, in which the output of each flip-flop is connected to the data input of the next flip-flop in the chain.

The latch 530 temporarily stores the data signal DATA and outputs the data signal DATA. In an exemplary embodiment, the latch 530 is one or more flip-flops.

The signal processor 540 converts the data signal DATA having a digital type to a data voltage having an analog type based on the gamma reference voltage VGREF and outputs the data voltage. The signal processor 540 may include a digital to analog converter to convert the data signal DATA from its digital form to analog data voltages. The signal processor 540 may convert the data signal DATA temporarily stored in the latch 530.

The buffer part 550 buffers the data voltage outputted from the signal processor 540 and outputs the data voltage to the data line DL. The buffer part 550 may include an amplifier connected to the data line DL.

According to an exemplary embodiment, the display area only displaying a static image among the first display area DAA and the second display area DAB is driven with the low driving frequency, so that the power consumption of the display apparatus may be reduced. In addition, only the portion corresponding to the gate lines displaying the video image in the first display area DAA and in the second display area DAB is driven with the high driving frequency and the remaining portion corresponding to the gate lines displaying the static image is driven with the low driving frequency so that the power consumption of the display apparatus may be further reduced.

Figure 10:
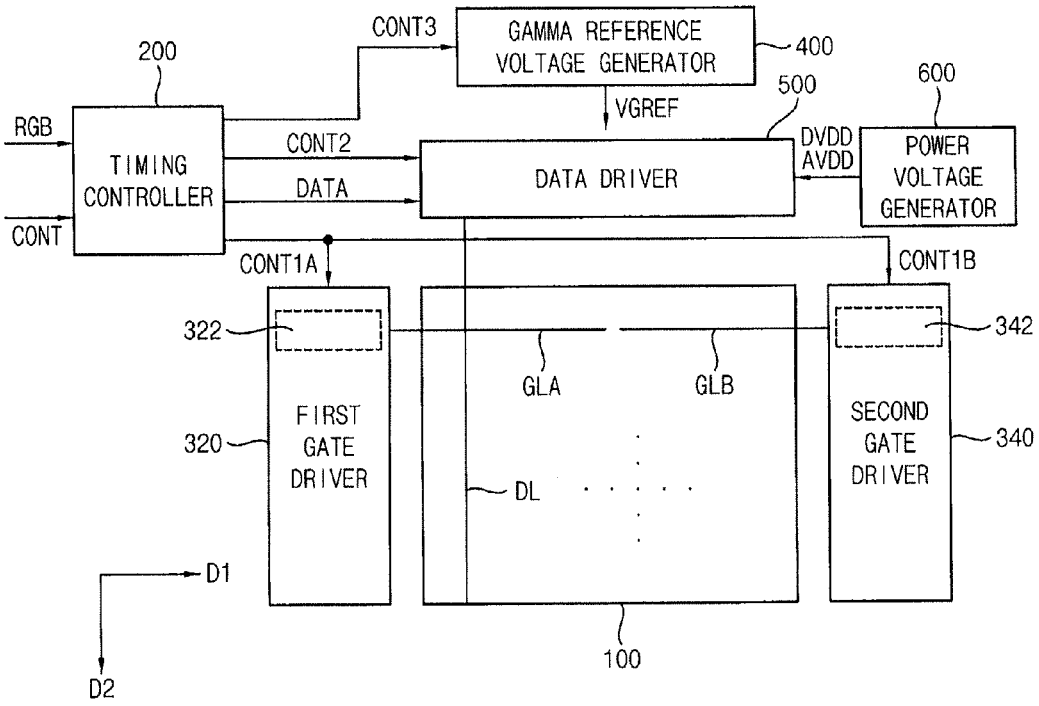
FIG. 10 is a block diagram illustrating a display apparatus according to an exemplary embodiment of the present inventive concept.
Figure 11:
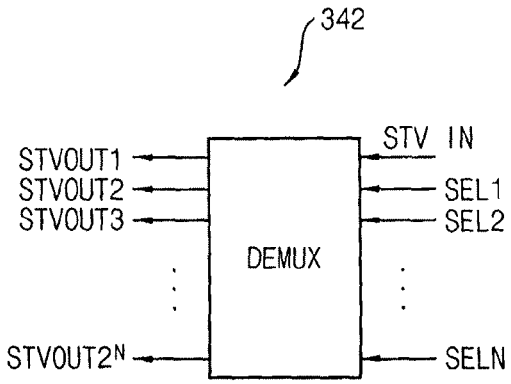
FIG. 11 is a block diagram illustrating a gate demultiplexer of a second gate driver of FIG. 10 according to an exemplary embodiment of the inventive concept.
Figure 12:
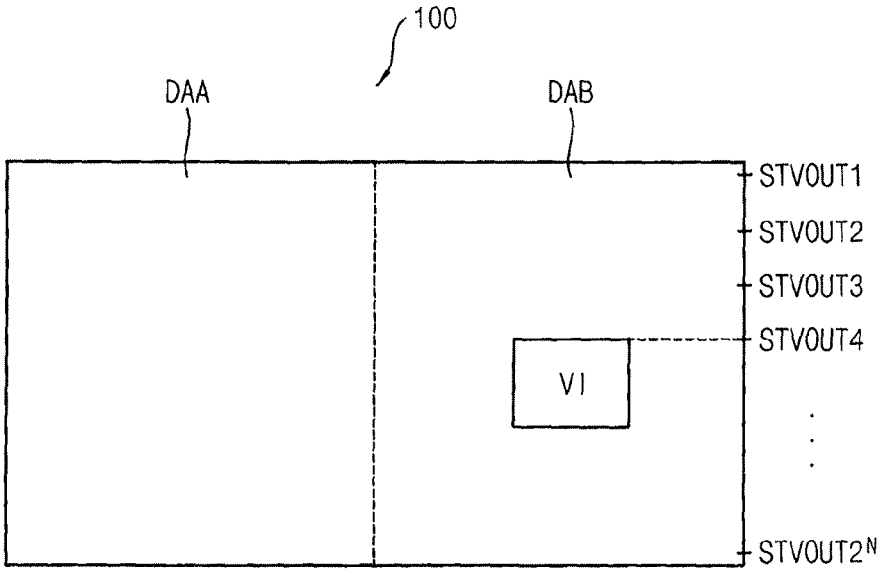
FIG. 12 is a conceptual diagram illustrating the display panel of FIG. 10 when a portion of a second display area of the display panel displays a video image.

FIG. 10 is a block diagram illustrating a display apparatus according to an exemplary embodiment of the present inventive concept. FIG. 11 is a block diagram illustrating a gate demultiplexer (demux) of a second gate driver of FIG. 10. FIG. 12 is a conceptual diagram illustrating the display panel of FIG. 10 when a portion of a second display area of the display panel displays a video image.

The display apparatus according to an exemplary embodiment is substantially the same as the display apparatus of the previous exemplary embodiment explained with reference to FIGS. 1 to 9 except for the structure and the operation of the first gate driver and the second gate driver. Thus, the same reference numerals will be used to refer to the same or like parts as those described in the previous exemplary embodiment of FIGS. 1 to 9 and any repetitive explanation concerning the above elements will be omitted.

Referring to FIGS. 10 to 12, the display apparatus includes a display panel 100 and a panel driver. The panel driver includes a timing controller 200, a first gate driver 320, a second gate driver 340, a gamma reference voltage generator 400, a data driver 500 and a power voltage generator 600.

The display panel 100 includes a first display area DAA on which a first gate line group GLA is disposed and a second display area DAB on which a second gate line group GLB is disposed.

The timing controller 200 determines a driving frequency of the display panel 100 based on the input image data RGB. The timing controller 200 determines a first driving frequency of the first display area DAA based on first input image data displayed on the first display area DAA. The timing controller 200 determines a second driving frequency of the second display area DAB based on second input image data displayed on the second display area DAB.

When the first input image data includes a video image, the timing controller 200 determines the first driving frequency as a high driving frequency. When the first input image data only represents a static image, the timing controller 200 determines the first driving frequency as a low driving frequency.

When the second input image data includes a video image, the timing controller 200 determines the second driving frequency as a high driving frequency. When the second input image data only represents a static image, the timing controller 200 determines the second driving frequency as a low driving frequency.

Therefore, in an exemplary embodiment, the first driving frequency of the first display area DAA may be different from the second driving frequency of the second display area DAB. When the first input image data includes a video image and the second input image data includes a video image, the first display area DAA and the second display area DAB are driven with the same high driving frequency. When the first input image data only represents a static image and the second input image data only represents a static image, the first display area DAA and the second display area DAB are driven with the same low driving frequency.

The first gate driver 320 generates gate signals driving the gate lines in the first gate line group GLA in response to the first gate control signal CONT1A received from the timing controller 200. The first gate driver 320 sequentially outputs the gate signals to the gate lines in the first gate line group GLA.

The second gate driver 340 generates gate signals driving the gate lines in the second gate line group GLA in response to the second gate control signal CONT1B received from the timing controller 200. The second gate driver 340 sequentially outputs the gate signals to the gate lines in the second gate line group GLB.

The gamma reference voltage generator 400 generates a gamma reference voltage VGREF in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages having an analog type using the gamma reference voltages VGREF. The data driver 500 outputs the data voltages to the data lines DL.

The first display area DAA does not display a video image and only displays a static image in FIG. 12. A portion of the second display area DAB displays a video image VI and remaining portions of the second display area DAB display a static image in FIG. 12.

Since the first input image data of the first display area DAA only includes a static image, the first display area DAA is driven with a low driving frequency. Since the second input image data of the second display area DAB includes a video image, the second display area DAB may be driven with a high driving frequency.

In an exemplary embodiment, when only the second display area DAB among the first and second display areas DAA and DAB includes a video image, the first display area DAA is driven with a low driving frequency. By using the horizontal local low frequency driving method, the power consumption of the display apparatus may be reduced.

The video image VI is not displayed in the whole second display area DAB but a portion of the second display area DAB. A vertical start point of the video image VI is at a fourth output point STVOUT4 in FIG. 12.

The second gate driver 340 may include a second gate demux 342. The second gate demux 342 receives an input vertical start signal (e.g., STV IN) and N selecting signals (SEL1, SEL2, . . . , SELN) and selects one of $2^N$ output vertical start signals (e.g., one of STVOUT1, STVOUT2, STVOUT3, . . . , STVOUT2$^N$).

The second gate demux 342 selects an output vertical start signal from $2^N$ output vertical start signals which represents the vertical start point of the video image VI.

For example, when N is 5, a SEL signal is 5-bit signal and the number of the output vertical start signals is thirty two. The thirty two output vertical start signals respectively represent vertical positions which are equally divided or equal spaced apart in the vertical direction.

When the SEL signal of the gate demux is four, the gate signals are applied to the gate lines from a fourth vertical position among thirty two vertical positions.

The first gate driver 320 includes a first gate demux 322. An operation of the first gate demux 322 may be substantially the same as the operation of the second gate demux 342.

In an exemplary embodiment, in the frames which only correspond to the frame cycle TB of the high frequency driving, the gate signals are normally outputted starting from the vertical start point of the video image VI and the gate signals before the vertical start point are skipped so that the portion from the vertical start point of the video image VI is driven with a high driving frequency and the portion above the vertical start point is driven with a low driving frequency. By using the vertical local low frequency driving method, the power consumption of the display apparatus may be further reduced.

According to an exemplary embodiment, the display area only displaying a static image among the first display area DAA and the second display area DAB is driven with the low driving frequency, so that the power consumption of the display apparatus may be reduced. In addition, only the portion corresponding to the gate lines displaying the video image in the first display area DAA and in the second display area DAB is driven with the high driving frequency and the remaining portions display a static image are driven with the low driving frequency so that the power consumption of the display apparatus may be further reduced.

According to at least one present exemplary embodiment of the inventive concept, a power consumption of the display apparatus may be reduced.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the present inventive concept. Accordingly, all such modifications are intended to be included within the scope of the present inventive concept.

What is claimed is:

1. A display apparatus comprising:

a display panel comprising a first display area on which a first gate line group is disposed and a second display area on which a second gate line group is disposed, the second gate line group being disconnected from the first gate line group;

a timing controller configured to determine a first driving frequency of the first display area based on first image data displayed on the first display area and a second driving frequency of the second display area based on second image data displayed on the second display area;

a first gate driver configured to control the first gate line group; and a second gate driver configured to control the second gate line group, wherein the first gate line group is spaced apart from the second gate line group in a first direction, wherein each gate line of the first gate line group are spaced apart from one another in a second direction, wherein each gate line of the second gate line group are spaced apart from one another in the second direction, and wherein the first direction is different from the second direction, wherein the second gate driver outputs first gate signals to all gate lines of the second gate line group during a first period and outputs the first gate signals only to the gate lines of the second gate line group corresponding to a first video image during a second period different from the first period, when the second image data includes both the first video image and a first static image.

2. The display apparatus of claim 1, wherein the first display area and the second display area are adjacent to each other in a horizontal direction.

3. The display apparatus of claim 1, wherein a size of the first display area is the same as a size of the second display area.

4. The display apparatus of claim 1, wherein the first gate driver is configured to apply a second gate signal to the first gate line group.

5. The display apparatus of claim 4, wherein when the first image data includes a second video image, the timing controller determines the first driving frequency as a high driving frequency, when the first image data only includes a second static image, the timing controller determines the first driving frequency as a low driving frequency, when the second image data includes the first video image, the timing controller determines the second driving frequency as a high driving frequency, and when the second image data only includes the first static image, the timing controller determines the second driving frequency as a low driving frequency.

6. The display apparatus of claim 5, wherein when the second image data includes both the first video image and the first static image, the second gate driver outputs the first gate signals to the gate lines of the second gate line group from a vertical start point of the first video image.

7. The display apparatus of claim 6, wherein the second gate driver comprises a demultiplexer, and the demultiplexer is configured to receive an input vertical start signal, receive N selecting signals and to select an output vertical start signal from $2^N$ output vertical start signals, the selected output vertical start signal representing the vertical start point of the first video image, where N is an integer greater than 1.

8. The display apparatus of claim 5, further comprising a data driver configured to output data voltages to the first display area and the second display area, wherein when the first image data only includes the second static image, a buffer of the data driver that performs a buffering based on the first image data is turned off during a blank period.

9. The display apparatus of claim 5, further comprising a data driver configured to output data voltages to the first display area and the second display area, wherein when the first image data only includes the second static image, a power voltage is not provided during a blank period to a portion of the data driver that processes the first image data.

10. The display apparatus of claim 1, wherein when the second image data includes both the first video image and the first static image, the timing controller generates a gate masking signal which blocks gate clock pulses outputted to the gate lines of the second gate line group corresponding to the first static image during the second period.

11. The display apparatus of claim 1, wherein the first direction is perpendicular to the second direction.

12. The display apparatus of claim 1, wherein the second gate driver outputs the first gate signals to all the gate lines of the second gate line group during a third period when the second input image data includes both the first video image and the first static image, wherein the first period and the third period have a duration of a single frame period, wherein the second period has a duration of two frame periods, and the second period is between the first and third periods.

13. A method of driving a display panel, the method comprising:

determining a first driving frequency based on first input image data, wherein the first input image data is displayed on a first display area on which a first gate line group is located;

determining a second driving frequency based on second input image data, wherein the second input image data is displayed on a second display area on which a second gate line group is located; and driving the first display area with the first driving frequency and the second display area with the second driving frequency, wherein the first gate line group is spaced apart from the second gate line group in a first direction, wherein each gate line of the first gate line group are spaced apart from one another in a second direction, wherein each gate line of the second gate line group are spaced apart from one another in the second direction, wherein the first direction is different from the second direction, and wherein the driving comprises outputting first gate signals to all gate lines of the second gate line group during a first period and outputting the first gate signals only to the gate lines of the second gate line group corresponding to a first video image during a second period different from the first period, when the second input image data includes both the first video image and a first static image.

14. The method of claim 13, wherein when the first input image data includes a second video image, the first driving frequency is determined as a high driving frequency, when the first input image data only includes a second static image, the first driving frequency is determined as a low driving frequency, when the second input image data includes the first video image, the second driving frequency is determined as a high driving frequency, and when the second input image data only includes the first static image, the second driving frequency is determined as a low driving frequency.

15. The method of claim 14, wherein when the second input data includes both the video image and the first static image, the first gate signals are outputted to the gate lines of the second gate line up from a vertical start point of the first video image.

16. The method of claim 15, wherein when the second input data includes both the first video image and the first static image, an output vertical start signal is selected from $2^N$ output vertical start signals based on an input vertical start signal and N selecting signals, and the first gate signals are outputted to the gate lines of the second gate line group from a gate line directed by the selected output vertical start signal where N is an integer ater than 1.

17. The method of claim 13, wherein when the second input data includes both the first video image and the first static image, a gate masking signal which blocks gate clock pulses outputted to the gate lines of the second gate line group corresponding to the first static image is generated during the second period.

18. The method of claim 13, wherein the first direction is perpendicular to the second direction.

19. The method of claim 13, wherein the driving further comprises outputting the first gate signals to all the gate lines of the second gate line group during a third period when the second input image data includes both the first video image and the first static image, wherein the first period and the third period have a duration of a single frame period, wherein the second period has a duration of two frame periods, and the second period is between the first and third periods.

* * * * *